US005238457A

United States Patent [19]

Triplett

[11] Patent Number: 5,238,457

[45] Date of Patent: Aug. 24, 1993

[54] CUE SLIDER DEVICE

[76] Inventor: Elwood Triplett, Box 262, Rugby, N. Dak. 58368

[21] Appl. No.: 878,195

[22] Filed: May 4, 1992

[51] Int. Cl.[5] ..... A63D 15/10

[52] U.S. Cl. ..... 273/23

[58] Field of Search ..... 273/23, 24

[56] References Cited

U.S. PATENT DOCUMENTS

| | | | |
|---|---|---|---|
| 453,797 | 6/1891 | Wickliff | 273/23 |
| 690,617 | 1/1902 | Rohland | 273/23 |
| 1,558,024 | 10/1925 | Logan | 273/23 |
| 2,352,294 | 6/1944 | Stapff | 273/24 |
| 2,931,649 | 4/1960 | Furda | 273/23 |
| 3,372,929 | 3/1968 | Molis | 273/23 |
| 3,488,054 | 1/1970 | Brzoska | 273/23 |
| 3,534,959 | 10/1970 | Elswick | 273/23 |
| 4,147,346 | 4/1979 | Giannetti | 273/23 |

FOREIGN PATENT DOCUMENTS

| | | | |
|---|---|---|---|
| 532666 | 4/1921 | France | 273/23 |
| 2196867 | 5/1988 | United Kingdom | 273/23 |

*Primary Examiner*—Theatrice Brown
*Attorney, Agent, or Firm*—Robert E. Kleve

[57] ABSTRACT

The invention comprises a sliding cue holder device having an upright post with a half circular cylindrical drum member fixed to the bottom of the post so that the cylindrical drum provides a rounded bottom surface for engaging the playing surface of a pool table, a horizontal sleeve is fixed across the upper portion of the post with slots in the sleeve extending from the forward end of the sleeve rearwardly and with tapered inner surfaces in the portions of the sleeve between the slots with the tapered inner surfaces tapering in a converging manner forwardly toward one another, whereby a pool cue having tapered forwardly converging outer surfaces may be inserted into sleeve to engage against the sleeve portions between the slots, with the sleeve portions between said slots being resiliently connected together at their rearward ends to resiliently engage against the tapered sides of the pool cue to fix the pool cue frictionally in the holder device, whereby the cue slider and pool cue may be slid in unison together axially of their length forward on a pool table to cause the pool cue to strike a desired pool ball with the rounded bottom of the holder device sliding on the table supporting the forward end of the pool cue.

3 Claims, 1 Drawing Sheet

CUE SLIDER DEVICE

This invention relates to sliding cue holders.

It is an object of the invention to provide a novel slidably attachable cue support or holder which can be slidably attached quickly and easily to the forward end of a cue to a selected position on the cue to support the cue so that the cue can be slid by the operator only holding the cue from the rearward end, and sliding the cue holder and cue forward and rearward with the cue holder supporting the cue in its forward and rearward movement.

It is another object of the invention to provide a novel cue holder which can be slidably attached and detached to a selected fixed position at the forward end of the cue and support the forward end of the cue, with means on the holder to minimize side to side movement of the cue holder while being slidable forward and rearward with the cue, while the cue is aimed, engaged and struck against a ball on the pool table with the cue otherwise supported during its sliding movement only by the operator grasping the rearward portion of the cue.

It is another object of the invention to provide a novel cue holder for supporting the forward end of a cue that a cue may be slid along a pool table to strike a pool ball with the cue held only at the rearward end by the operator of the cue.

Further objects and advantages of the invention will become apparent as the description proceeds, and when taken in conjunction with the accompanying drawings wherein:

BRIEF DESCRIPTION OF PREFERRED EMBODIMENT:

Briefly stated, the invention comprises a sliding cue holder device having a rounded semi-circular base with an upright post fixed to the top of the base and extending upward, a resilient plastic sleeve fixed across the top of the post with horizontal longitudinal slits extending longitudinally along the axial length of the sleeve from openings in the forward end of the sleeve to form in the sleeve between the slits tapered axially converging flap portions each resiliently urged, through their resilient connection to the sleeve at their rearward ends, radially inward toward one another in a frusto conical configuration to resiliently engage and grasp and hold a cue when introduced into the sleeve, whereby a tapered cue may be inserted into the sleeve from the rearward end of the sleeve and the flap portions will engage and grasp forward portions of the cue in the position in the sleeve selected by the operator, and with the flaps at their forward ends being smaller than the forward end of the cue so that the cue may be held by the flaps in various selected positions on the forward end of the cue, whereby, with the cue held in place on the holder, resiliently retained by the flaps, the operator may slide the cue and cue holder forward in unison to engage and strike a pool ball on the pool table, with holder's rounded bottom sliding along the table supporting the forward end of the cue, while the operator through grasping the rearward end of the cue is supporting the rearward end of the cue and moving the cue axially forward.

Figure 1:
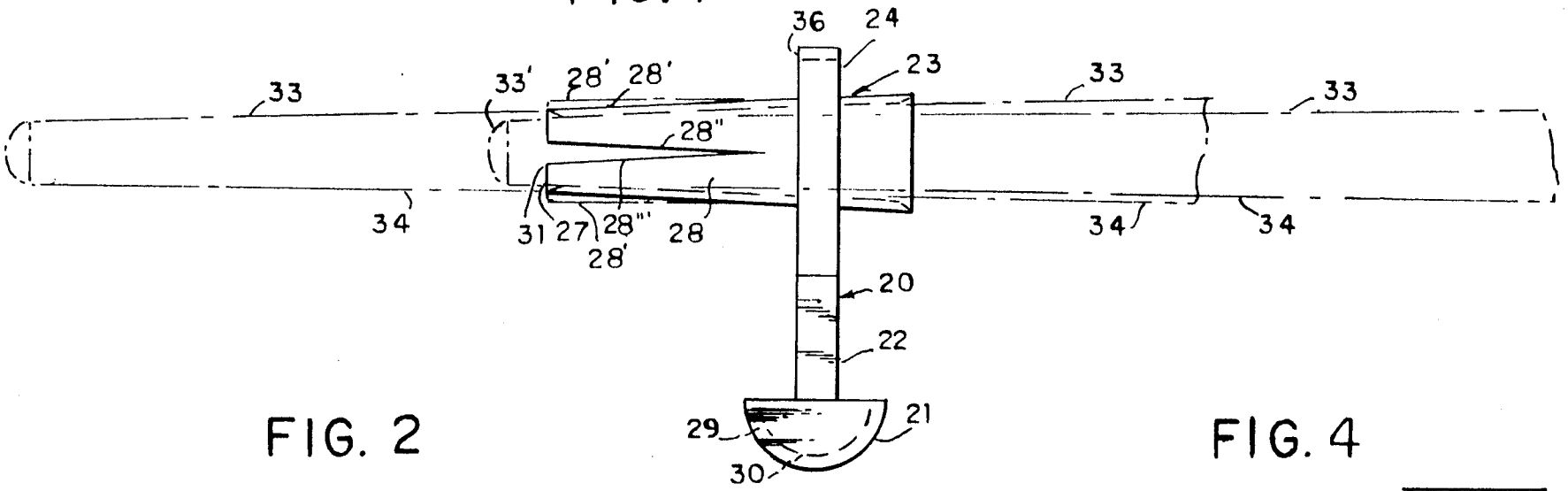
FIG. 1 is a side elevational view of the sliding cue holder invention illustrating the cue stick being introduced into the holder at the right, and in operative position at the left, in phantom lines.
Figure 4:
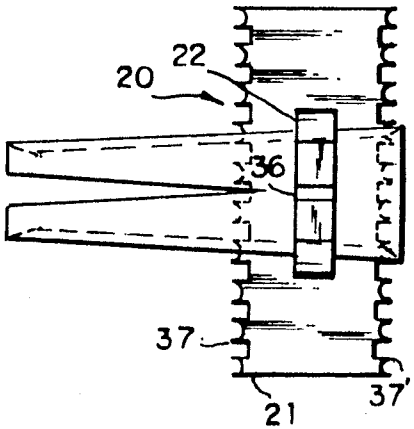
FIG. 4 is a top plan view of the sliding cue holder.
Figure 3:
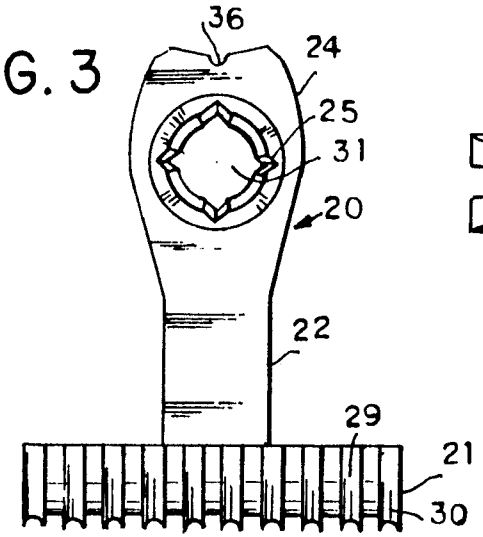
FIG. 3 is a front elevational view of the sliding cue holder.
Figure 2:
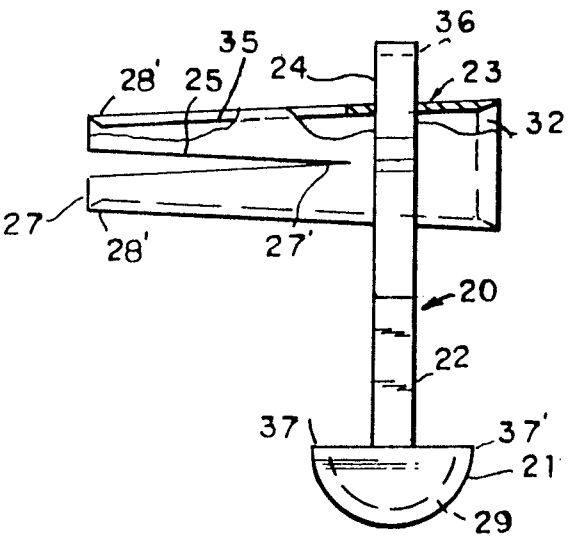
FIG. 2 is a side view similar to FIG. 1 of the sliding cue holder.

Referring more particularly to the drawing, in FIGS. 1, 2, and 3, the cue holder invention is illustrated having a semi-circular drum like rounded bottom 21 with an upright post 22 fixed to the top of the rounded bottom and projecting upward. A sleeve or tube 23 is fixed across the upper portion 24 of the post 22. The sleeve 23 has a plurality of horizontal slots 25 at four even intervals about the circumference of the sleeve. The slots 25 extend in from the forward edge 27 of the sleeve with the side edges 28' and 28'' forming the slot tapering toward one another and converging together at the rear end 27' of the slots. The rearward ends of the slots terminate forward of the post 22. The slots 25, into the sleeve 23, form four arcuate flanges or panels 28 and the panels 28 are resiliently connected together by the sleeve at their rearward ends.

The bottom portion 21 has a plurality of semi-circular ribs 29 extending arcuately about the bottom of the bottom portion 21. The ribs 29 project downward and outerward and each have a concave center portion 30 extending along the length.

The inner diameter of the opening 31 formed by the tips 28' at the forward ends of the panels 28 slightly smaller than the outer diameter of forward one third of the striking end of a conventional pool cue and therefore slightly smaller than the outside diameter of the cue at any point along its entire length. The rearward opening 32 into the sleeve of the sliding holder 20 has an inside diameter slightly larger than the outside diameter 34 of the forward one third of the striking end of a conventional tapered pool cue 33. The inside surfaces of the forward part of the sleeve form a tapered surface 35. The tapered surface 35 has a greater angle, from its center axis of the sleeve, than the angle of the taper of the cue from its center axis.

OPERATION

The sliding cue holder 20 operates as follows:

ATTACHMENT OF CUE TO CUE HOLDER

The cue holder 20 will be attached to the tapered forward end 33' of a conventional pool cue 33 by sliding the forward felt tip 33', forming the striking end of the pool cue, into the sleeve 23 forwardly through the rear opening into the tapered forward panels 28 and out through the tips 28' of the panels forming the forward opening 31. The sleeve will be slid to its desired position along the forward one third of the pool cue.

The tips of the flaps 28 will engage against the outside of the pool cue anywhere along the forward one third of the pool cue where the cue is positioned in the holder. The holder will remain in that selected position frictionally fixed in that position with sufficient friction to hold the cue holder in its selected position while sliding the cue holder on the table on its ribbed bottom member 21 in unison with the cue, by the operator moving the rear end of the cue to move the cue and holder.

The flaps or panels 28, being resilient will bow out or flatten out for flush contact with the cue for a relatively short portion of the flaps along their axial length, rearward from the tips, to provide sufficient friction to hold the cue holder in its selected position on the pool cue while sliding the cue holder on the table on its ribbed bottom member 21, by the operator moving the rear end of the cue.

The inside diameter of the flaps at their tips is approximately ½ inch, which is smaller the outside diameter of a conventional pool cue at any point along its length so that the tips can grip a conventional cue at any point along the forward one third of the cue.

The panels 28 taper rearwardly and outwardly along their inside surfaces with the inside diameter of the panels at the rearward ends 28'' of the slots being approximately ⅝ inch, or near the inside rear diameter 32 of the sleeve opening which is 11/16 inch. This ⅝ inch is larger than the outside diameter of most conventional pool cues along their forward portion to at least near the forward one third of the pool cue. Consequently the rearward ends of the panels will be free from contact with the cue along nearly all of the forward one third of the cue when the sleeve is receiving the uce. The flaps however can flex out toward horizontal to approximately ⅝ inch in reaction to their receiving and being engaged by the forward end of the cue to provide frictional engagement at any point along the forward one third of the cue, until that point on the cue which has an outer diameter of approximately ⅝ inch reaches the rear ends 27' of the slots. This enables the holder to be selectively positioned along the forward one third of the cue by the tips of the panels engaging the cue.

Thus, the cue 33 can slide forward into the sleeve until that point on the cue, that its inside diameter equals the inside diameter of the sleeve where the rear ends 27' of the slots terminate, reaches that point 27' where the rear ends of the slots terminate.

OPERATION OF THE CUE AND CUE HOLDER

The cue and cue holder will be moved axially of the length of the cue along the pool table, with the cue holder sliding on the ribbed bottom and with the cue and cue holder sliding or moving in unison, with the operator moving the cue and cue holder by grasping the cue at the rear end of the cue to enable the cue at its striking end to strike a pool ball.

The ribs 29 along the bottom portion 21 of the holder provide, through the concavity in the ribs, relatively sharp side edges 35 to engage the pool table to either side of the longitudinal axis of the pool cue, to limit and reduce side to side movement of the holder and cue when sliding the cue holder and cue longitudinally and axially forward to strike a ball.

The post 22 has a slot 36 in its top which serves as a sight, to assist the operator insighting and aligning the pool cue and holder axially with the pool ball with more accuracy, when the operator wishes to strike a ball with the cue.

The bottom portion 21 of the cue holder 20 has a relatively small front to rear dimension from its forward edge 37 to its rearward edge 37', in relation to the height and size of the pool balls and the length of the pool cue, so that the cue holder can more easily fit onto the pool table between the pool balls when aligning and positioning the pool cue and holder so that they can be slid along the pool table to strike a pool ball, and thereby providing less likehood of the holder striking another ball when moving the holder and cue to strike the selected ball.

Thus, it will be seen that a novel cue holder has been provided which enables a cue to be more accurately moved on a pool table to strike a pool ball while using only one hand, and which device enables and assists persons having a handicapped situation which limits their use of their arms or hands.

The panel expansion enables the panels and therefore the holder to grip the cue at any given point from the tip and any point thereafter along the forward one third of the cue shaft.

It will be obvious that various changes and departures may be made to the invention without departing from the spirit and scope thereof; and accordingly, it is not intended that the invention be limited to that specifically described in the specification or as illustrated in the drawing, but only as set forth in the appended claims wherein:

What is claimed is:

1. A pool cue slider device comprising;

an upwardly extending support post, said post having a substantially half circular cylindrical bottom end for engaging a pool table playing surface; a resilient sleeve affixed to and adjacent the upper end of said post and being substantially perpendicular to the longitudinal axis thereof; said sleeve having a forward end and a rearward end and beong of a frustroconical configuration, said forward end having a diameter smaller than the diameter of said rearward end such that the inner surface of said sleeve converge from said rearward end to said forward end, said rearward end having a diameter less than the largest cross-sectional diameter of a regulation pool cue; at least one pair of diameterically opposed slots extending along said sleeve from said forward end a predetermined distance towards said rearward end, said slots being tapered from said forward end and converging over said predetermined distance to therefore define opposed flexible portions at said forward end of said sleeve; said sleeve being adapted to receive the forward tapered smaller striking end of a pool cue, whereby said striking end may be inserted through said sleeve from said rearward end until said sleeve flexible portions firmly engage the surface of the pool cue and fixedly hold the pool cue intermediate its ends in said sleeve, whereby said pool cue slider and pool cue may be slid in unison together on a pool table playing surface to cause the pool cue to strike a ball.

2. A pool cue slider device as defined in claim 1 wherein, said cylindrical bottom end extends substantially perpendicular to the longitudinal axis of said sleeve, said cylindrical bottom end having a plurality of spaced apart semi-circular ribs on the surface thereof, each of said ribs having a concaved area extending along its length and extending transverse to the longitycinal axis of said cylindrical bottom end.

3. A pool cue slider device as defined in claim 1 wherein, a sighting means is formed in said post, said sighting means being a slot defined in the upper of said post and extending parallel to the longitudinal axis of said sleeve.

* * * * *